US005906129A

United States Patent [19]

Quambusch

[11] Patent Number: 5,906,129

[45] Date of Patent: May 25, 1999

[54] PROCESS FOR ROLLING FLAT MATERIAL AND STRIP

[75] Inventor: Herbert Quambusch, Ratingen, Germany

[73] Assignee: Mannesmann AG, Düsseldorf, Germany

[21] Appl. No.: 09/111,847

[22] Filed: Jul. 8, 1998

[30] Foreign Application Priority Data

Jul. 9, 1997 [DE] Germany ..... 197 30 262

[51] Int. Cl.[6] ..... B21B 29/00

[52] U.S. Cl. ..... 72/241.8; 72/237; 72/365.2

[58] Field of Search ..... 72/10.4, 10.6, 72/14.4, 14.5, 241.6, 241.8, 237, 247, 365.2

[56] References Cited

U.S. PATENT DOCUMENTS

| | | | |
|---|---|---|---|
| 4,773,246 | 9/1988 | Perret | 72/241.8 |
| 5,638,716 | 6/1997 | Jonen | 72/241.8 |
| 5,752,404 | 5/1998 | White et al. | 72/247 |

FOREIGN PATENT DOCUMENTS

| | | | |
|---|---|---|---|
| 37 28 795 A1 | 3/1989 | Germany | B21B 31/18 |

*Primary Examiner*—Joseph J. Hall, III
*Assistant Examiner*—Ed Tolan
*Attorney, Agent, or Firm*—Cohen, Pontani, Lieberman & Pavane

[57] ABSTRACT

The present invention relates to a process for rolling a roll material through a roll stand having work rolls and support rolls and having devices for balancing and positively and negatively bending the work rolls mounted in chucks of the work rolls. The process includes setting a balancing force by moving the work rolls against the support rolls without clearance when the roll gap is open by using the piston-cylinder units for positive and negative roll bending, setting the pressure in the piston-cylinder units for negative bending so as to attain the roll gap correction needed under load to control the profile and flatness of the roll train and setting the pressure in the piston-cylinder units for balancing and positive bending higher than the amount of balancing force needed. The piston-cylinder units are controlled for exerting a roll force including the positive bending force and the negative bending force on the work rolls when the roll material is inserted in the roll gap and expands the roll gap to a desired size. The piston-cylinder units are also controlled for exerting the balancing force on the work rolls after the end of the roll material exits the roll gap.

3 Claims, No Drawings

PROCESS FOR ROLLING FLAT MATERIAL AND STRIP

BACKGROUND OF THE INVENTION

1. Field of the Invention

The invention relates to a process for rolling flat material and strip in a roll stand having work rolls and support rolls and having devices for balancing the work rolls, positively bending the work rolls and negatively bending the work rolls. The devices include vertically arranged piston-cylinder units that, resting bilaterally on the roll stand, are placed from above and below against projections embodied on chucks of the work rolls and extending toward the housing window. The piston-cylinder units may, depending on their pressurization, urge the chucks of the work rolls toward or away from each other.

2. Description of the Related Art

In four-high roll stands, various adjustment elements are available to influence the roll gap and the strip profile. These adjustments include positive and negative bending devices for the work rolls. The plane of the vertical roll gap between the work rolls may be bent or curved by hydraulic cylinders in both directions via their longitudinal axes. The positive and negative bending devices allow the cross-sectional profile of the rolled material to be adjusted or changed within certain limits.

The "positive" bending is accomplished using piston-cylinder units that also serve to balance the rolls and are placed directly or indirectly in the housing window of the roll stands, for example, in hydraulic blocks. Located in these hydraulic blocks or in active connection with the support roll chucks are the piston-cylinder units for "negative" bending, with which the rolls may be bent in the sense of a convex cross-sectional contour of the roll gap.

A problem with the prior art devices is that the negative bending devices are not activateable until the material to be rolled has entered the roll gap. To pressurize the piston-cylinder units for negative work roll bending, a roll load must exist. Otherwise contact between the work rolls and support rolls is not guaranteed. This requirement that the material actually enter the roll gap before the adjustment of the negative bending results in non-standard lengths of strip at the beginning and end portions of the material to be rolled. These beginning and end portions of the material to be rolled cannot be sold and are considered lost pieces. These lost pieces detract from the profitability of the roll mill. The amount of lost strip is considerable, due to the time needed for the switching and control procedures involved with setting the negative bending device.

SUMMARY OF THE INVENTION

The object of the present invention is to minimize the loss of non-standard strip lengths starting from known processes for positive and negative work roll bending, and thus to improve the profitability of the rolling mill, by suitably controlling the piston-cylinder units for positive roll bending and work roll balancing as well as the piston-cylinder units for negative roll bending.

According to the present invention, a process for rolling a roll material through a roll stand having work rolls and support rolls and having devices for balancing and positively and negatively bending the work rolls mounted in chucks of the work rolls includes setting a balancing force by moving the work rolls against the support rolls without clearance when the roll gap is open by using the piston-cylinder units for positive and negative roll bending, setting the pressure in the piston-cylinder units for negative bending so as to attain the roll gap correction needed under load to control the profile and flatness of the roll train and setting the pressure in the piston-cylinder units for balancing and positive bending higher than the amount of balancing force needed. The piston-cylinder units are controlled for exerting a roll force including the positive bending force and the negative bending force on the work rolls when the roll material is inserted in the roll gap and expands the roll gap to a desired size. The piston-cylinder units are also controlled for exerting the balancing force on the work rolls after the end of the roll material exits the roll gap.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

The present invention proposes a process including the following process steps:

a) setting a balancing force for moving work rolls of a roll stand against support rolls without clearance when a roll gap between the work rolls is open, by setting pressure in piston-cylinder units for positive and negative roll bending;

b) setting the pressure in the piston-cylinder units for negative bending, and thus the negative roll bending force, to attain the roll gap correction needed under load to control the profile and flatness of the strip;

c) setting the pressure in the piston-cylinder units for balancing and positive roll bending to a setting higher than the balancing force set in step a. for positive bending, and thus the positive roll bending force;

d) controlling the piston-cylinder units for positive and negative bending such that the negative roll bending force and the positive roll bending force set in steps b. and c. are exerted on the work rolls by the piston-cylinder units for positive and negative bending when a roll material is inserted in the roll gap and expands the roll gap to a desired size; and e) controlling the piston-cylinder units for positive and negative bending such that the required balancing force set in step a. is exerted on the work rolls when the roll material exits the roll gap.

When the roll gap between the work rolls is open and empty, the work rolls are balanced by the piston-cylinder units for positive and negative roll bending so that the pressure force existing between the support rolls and work rolls is sufficient to rotate the support rolls in a shear-free manner and to eliminate the bearing clearances of the support rolls and work rolls. The negative roll bending force, and thus the pressure in the associated piston-cylinder units, is regulated by a servo valve so that the roll gap contour needed under load to control the profile and flatness of the roll train is attained. The positive roll bending force is thereby set higher by the amount of balancing force needed.

According to the invention, after the roll material enters the roll gap, the cylinders of the piston-cylinder units for positive work roll bending are moved to the chucks and fixed in position and the balancing force is taken over by a roll force comprising the positive and negative roll bending forces, whereby the increase in force occurring in the cylinders for positive work roll bending is compensated for by an increase in the force for negative roll bending. The roll material forces the roll gap to expand to the desired size, whereby the balancing force is overcome by the roll force. The expansion of the roll gap disconnects the balancing cylinders from the chucks of the work rolls. When the roll gap is fully expanded, the cylinders of the piston-cylinder units for negative bending are moved against the chucks and fixed in position. The cylinders for negative work roll bending reinforce the bending effect of the work rolls due to the roll force and thus produce the desired roll gap contour in the fully expanded position.

When the end of the roll material leaves the roll gap, the roll stand springs back into the unloaded position and, with the control valve closed, the balancing force required by the balancing cylinders to prevent the work rolls from hitting each other is thus automatically produced. In this way, it is possible to control the roll gap correction of the strip profile all the way to the exiting end of the strip. The end losses that impair productivity are therefore avoided by the invention.

In addition, according to another feature of the invention, it is possible to switch from negative to positive bending of the rolls by increasing or decreasing the pressure in the piston-cylinder units for positive and negative roll bending. As a result, the additional adjustment element for negative roll bending is effective even during the strip run and thus is particularly important during continuous rolling.

The hydraulic equipment and control devices are designed such that the appropriate switching processes can be carried out and pressure fluctuations/pressure peaks compensated for.

The invention may be used in broad strip finishing trains, four-high reversing stands, plate sheet trains, Steckel trains and thin slab casting-and-rolling machines. A particular advantage of the invention is that the control device needed for the process may be retrofitted into existing rolling mills, whereby the existing piston-cylinder units may be used.

The invention is not limited by the embodiments described above which are presented as examples only but can be modified in various ways within the scope of protection defmed by the appended patent claims.

I claim:

1. A process for rolling a roll material in a roll stand, the roll stand having work rolls and support rolls and devices for balancing the work rolls and positively and negatively bending the work rolls mounted in chucks of the work rolls, the devices including vertically arranged piston-cylinder units resting bilaterally on the roll stand and arranged from above and below against projections embodied on the chucks of the work rolls and extending toward a housing window of the roll stand, the piston-cylinder units being pressurizable for moving the chucks toward or away from each other, said process comprising the steps of:

a) setting a balancing force using the piston-cylinder units for positive and negative roll bending by moving the work rolls against the support rolls without clearance when the roll gap between the work rolls is open and empty;

b) setting a negative roll bending force by setting the pressure in the piston-cylinder units for negative bending to attain the roll gap correction needed under load to control the profile and flatness of a roll material;

c) setting a positive roll bending force by setting the pressure in the piston-cylinder units for balancing and positive bending higher than the required balancing force;

d) controlling the piston-cylinder units for positive and negative bending such that a roll force comprising the negative roll bending force set in step b. and the positive roll bending force set in step c. is exerted on the work rolls when the roll material is inserted in the roll gap and expands the roll gap to a desired size; and e) controlling the piston-cylinder units for positive and negative bending such that the required balancing force set in step a. is exerted on the work rolls when the end of the roll material exits the roll gap.

2. The process for rolling flat material and strip of claim 1, wherein said step d. comprises moving cylinders of the piston-cylinder units for positive bending to the chucks and fixing the cylinders in position after the balancing force has been overcome by the roll force when the roll gap is expanded to the desired size by inserting the roll material between the work rolls; and compensating for an increase in force that occurs in the cylinders of the piston-cylinder units for positive bending with an increase in the force applied by the piston-cylinder units for negative bending.

3. The process for rolling flat material and strip in a roll stand of claim 1, further comprising the step of switching from negative to positive bending of the rolls during the rolling process by suitably increasing or reducing the pressure in the piston-cylinder units for positive and negative roll bending.

* * * * *